US006105993A

United States Patent [19]

Gignoux

[11] Patent Number: 6,105,993

[45] Date of Patent: Aug. 22, 2000

[54] INTERFACE FOR CONNECTING A BOOT AND A GLIDING BOARD

[75] Inventor: Pierre Gignoux, Coublevie, France

[73] Assignee: Skis Rossignol S.A., Voiron, France

[21] Appl. No.: 09/072,491

[22] Filed: May 4, 1998

[51] Int. Cl.[7] ..... A63C 9/08

[52] U.S. Cl. ..... 280/613; 280/617; 280/623; 280/11.36

[58] Field of Search ..... 280/613, 617, 280/618, 11.36, 607, 623, 624, 625

[56] References Cited

U.S. PATENT DOCUMENTS

| | | | |
|---|---|---|---|
| 1,167,183 | 1/1916 | King | 280/11.36 |
| 4,021,056 | 5/1977 | Oakes et al. | 280/613 |
| 4,177,584 | 12/1979 | Beyl | 280/613 X |
| 5,524,919 | 6/1996 | Sedlmair | 280/617 X |
| 5,697,631 | 12/1997 | Ratzek et al. | 280/613 |
| 5,899,483 | 5/1999 | Paris | 280/11.36 X |

*Primary Examiner*—Michael Mar
*Attorney, Agent, or Firm*—Bugnion S.A.; John Moetteli

[57] ABSTRACT

An interface is provided for connecting a sports boot with a gliding board. The boot has a tall, soft upper, a flexible sole with at least one longitudinal groove of trapezoidal cross section and four attachment points. The interface has (1) on the boot side, an outer profile of trapezoidal overall shape similar to that of the groove in the boot and which is intended to engage in the groove of the boot and (2) means of automatically attaching and locking the four attachment points of the boot. At the rear of the interface, an arm rises up approximately vertically and is equipped with means of connection to the back of the upper of the boot. The lower part of the interface has attachment means adapted to the particular type of gliding board.

11 Claims, 5 Drawing Sheets

Fig.2a
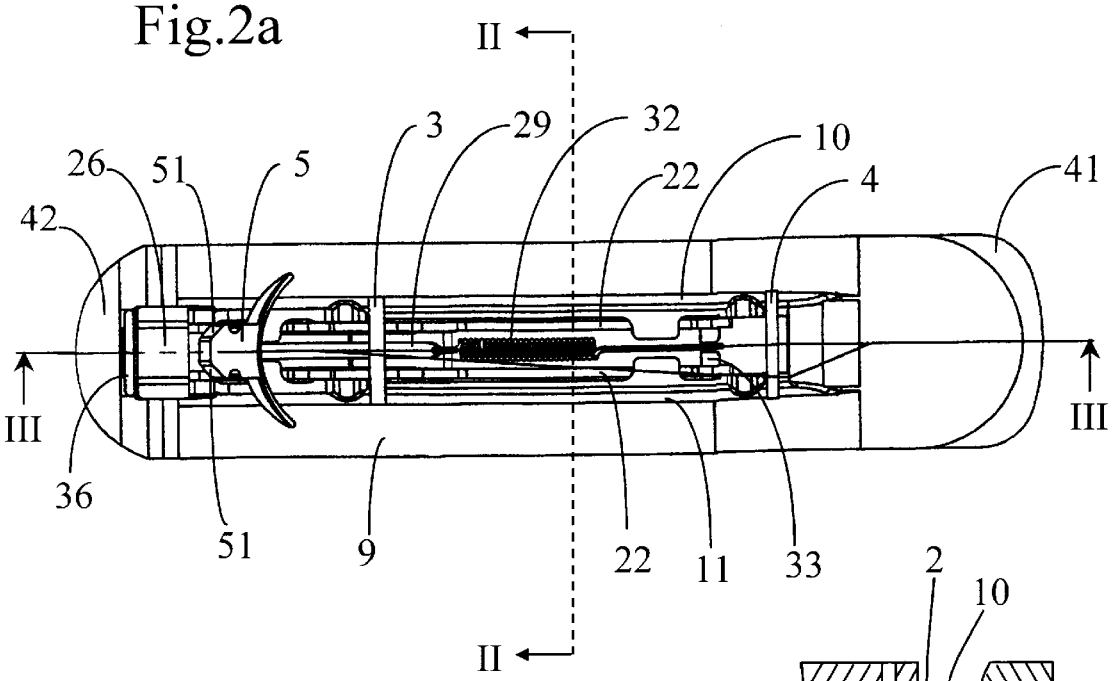
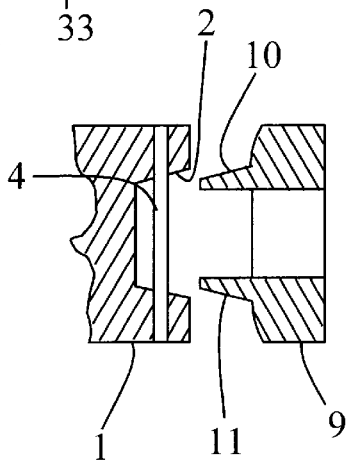
Fig.2b
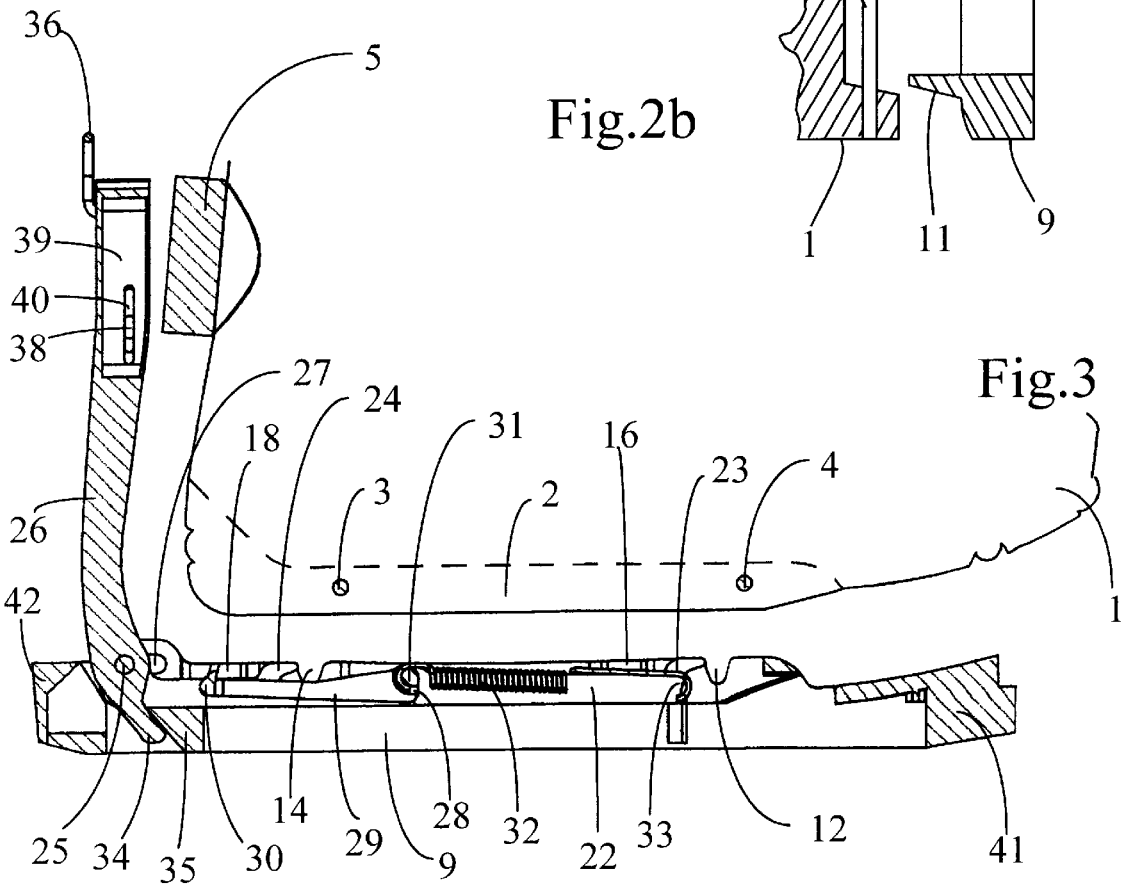
Fig.3

INTERFACE FOR CONNECTING A BOOT AND A GLIDING BOARD

FIELD OF THE INVENTION

The invention relates to an interface for connecting, a sports boot with a tall, soft upper, whose sole has four catching points, and a gliding board which has means of attaching the attachment points of the boot.

PRIOR ART

U.S. Pat. No. 4,177,584 discloses a ski boot whose sole has passing across it two transverse rods which attach to a ski that is equipped with four hooks that catch on the rods, at four points, on each side of the boot. These hooks are parted elastically by the pressure of the foot on the ramps of the hooks.

From another source, Patent FR 2 705 248 discloses a device for holding a boot or shoe of flexible type on a gliding board, particularly a snowboard, in which the sole of the boot or shoe has a longitudinal axial groove of trapezoidal profile engaging over a binding that has a body of trapezoidal profile, the groove in the boot or shoe having a rod passing across it that clips under a sliding bolt when the snowboard is fitted to the boot or shoe. In another embodiment, the profiled body of the binding is split into two by a longitudinal groove and the rod of the boot or shoe clips in behind two sliding bolts at two points. The boot or shoe is released either by pulling on the sliding bolts directly using a strap, or by means of a lateral lever.

These bindings certainly provide a perfectly sufficient interface between the user's leg and the gliding board so long as the boot or shoe is rigid enough to provide sufficient lateral holding. In the case of the assembly according to Patent FR 2 705 248, the sole must furthermore be rigid because it is fixed by just one transverse rod. Now, the current trend is to use a comfortable boot or shoe that allows walking. Such a boot or shoe does not only have to have a soft upper, but must also have a flexible sole. Furthermore, the trend is to offer the possibility of using the same boot or shoe for different gliding boards, whether this be a downhill ski, a compact ski for climbing or a snowboard.

SUMMARY OF THE INVENTION

The object of the invention is to produce an interface between a boot with a soft upper and flexible sole, and a gliding board, so that the connection between the leg and the gliding board is rigid enough to allow the gliding board to be controlled correctly, this interface having to be universal in its essential components, that is to say the same for the various types of gliding board, adaptation, if necessary, to suit the particular type of gliding board having to effect only the means of attaching this interface to the gliding board, so that the same boot can be used for the various types of gliding boards.

Furthermore, the upper part of this interface must be able to accommodate boots of all sizes.

The invention proposes an interface for connecting, a sports boot with a tall, soft upper, whose flexible sole, that allows walking, has at least one longitudinal groove of standardized trapezoidal cross section and four attachment points and, a gliding board, exhibiting, on the boot side, an outer profile of standardized trapezoidal overall shape similar to that of the groove in the boot and intended to engage, without play, in the groove of the boot and means of automatically attaching and locking the four attachment points of the boot and, at the rear, an arm rising up approximately vertically and equipped with means of connection to the back of the upper of the boot, the lower part of said interface exhibiting attachment means adapted to the particular type of gliding board.

The four-point attachment, for example using two rods, ensures that the sole is attached correctly, even though this sole is flexible.

The arm rising up at the rear permits lateral support to the upper of the boot at the ankle.

According to the preferred embodiment of the invention, the approximately vertical arm simultaneously constitutes a release lever. This release lever is advantageously articulated to the rear of the interface and acts directly on the attachment and locking element or elements.

The connection between the approximately vertical arm and the upper of the boot is preferably achieved in a simple and light weight way, for example using a spring mounted so that it can slide longitudinally along the approximately vertical arm. This spring is in the overall shape of a U having a narrowing that forms two opposed teeth intended to clip into grooves in the boot.

The connection is interrupted simply by pulling upward on the spring, ramps provided on the approximately vertical arm parting the spring.

BRIEF DESCRIPTION OF THE DRAWINGS

The appended drawing depicts, by way of example, one embodiment of the invention and its adaptation to various types of gliding board.

FIG. 2*a* is a plan view, from above, of the interface depicted in FIG. 1.

FIG. 2*b* is a cross sectional view taken along line II—II of FIG. 2*a* and showing the boot.

FIG. 3 is a view in axial section on III—III of FIG. 2.

DESCRIPTION OF THE PREFERRED EMBODIMENTS

Figure 1:
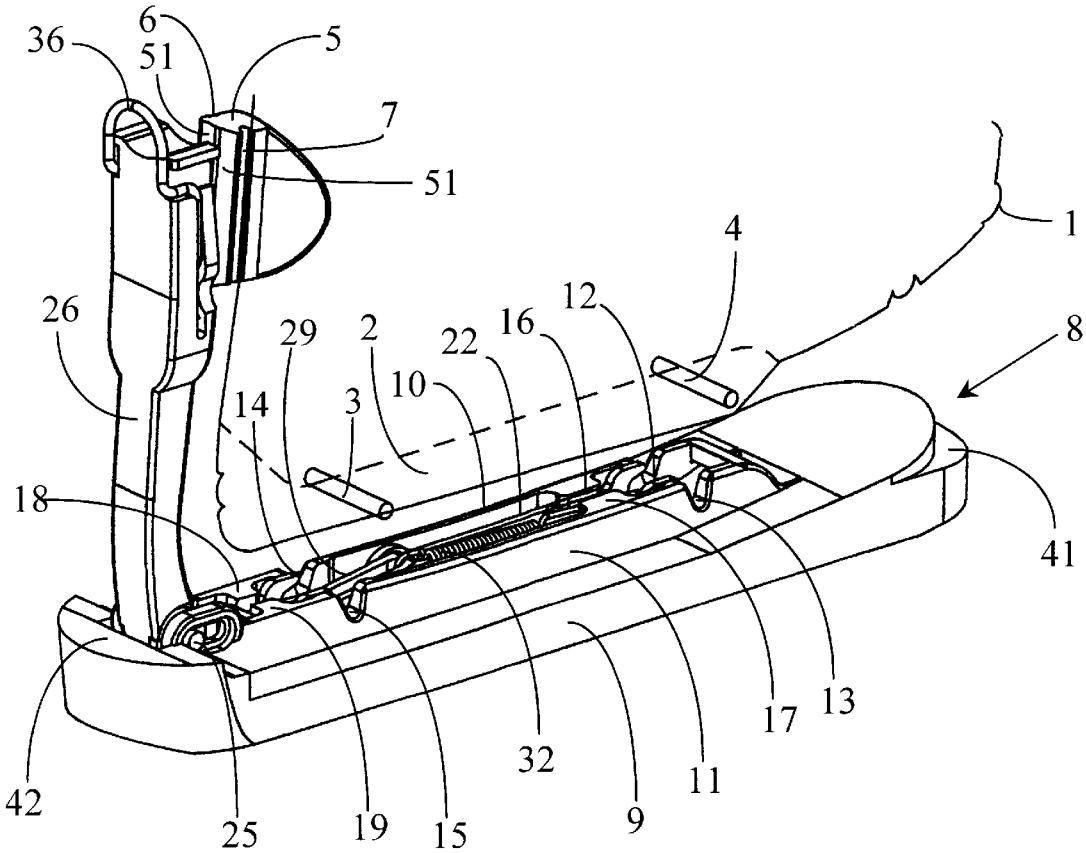
FIG. 1 is a perspective view of the interface according to the invention, adapted to be attached to a downhill ski and depicted in the unlocked position.

Depicted very partially in FIGS. 1 and 3 is a boot 1 that has a longitudinal axial groove. 2 similar to the groove in the boot described in Patent FR 2 705 248. This groove 2 has two transverse rods 3, 4 passing across it at right angles to the axis of the groove 2. The boot 1 is a boot with a soft tall upper and a flexible sole allowing easy walking. Fixed to the back of the upper of the boot 1, at ankle height, by bonding or any other means, is a piece 5 of prismatic shape with an approximately vertical axis and having, on each side, two lateral grooves 6 and 7 parallel to the axis of the piece 5. This piece 5 is made, for example, of hard plastic.

Figure 4:
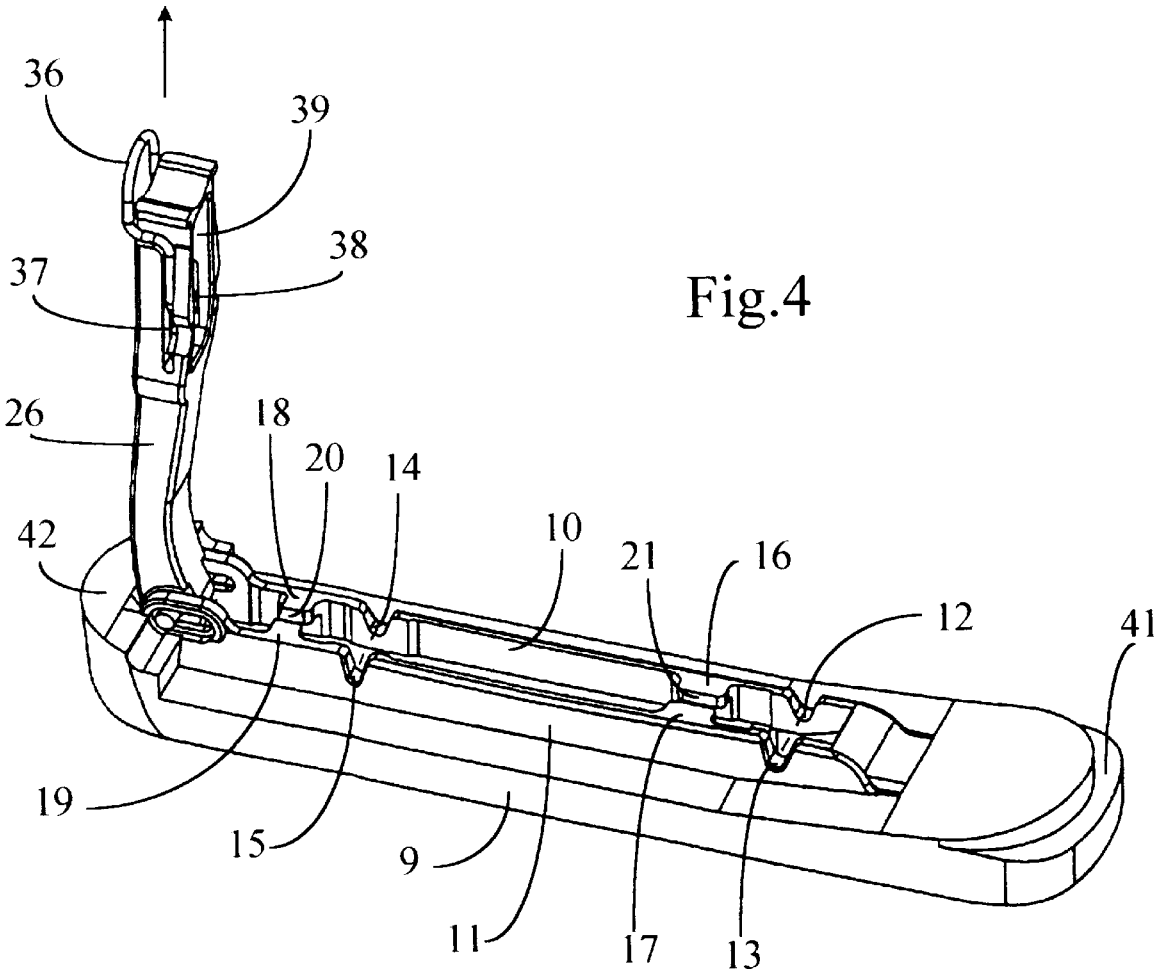
FIG. 4 is another perspective view of this same interface, but without the catching and locking means.

The interface 8 comprises a base 9 from which there rise two parallel longitudinal ribs 10 and 11, the outer lateral faces of which are inclined in such a way that the two ribs 10 and 11 are contained in an envelope of trapezoidal cross section similar to the trapezoidal cross section of the groove 2 in the boot. The ribs 10 and 11 have two pairs of V-shaped notches 12, 13 and 14, 15, the notches of each of the pairs being aligned transversely along an axis perpendicular to the direction of the ribs 10 and 11. These notches can be seen more clearly in FIG. 4 to which reference is also made for the remainder of the description. The notches 12 to 15 are intended to accommodate the rods 3 and 4 to attach them at four points in a quadrilateral. The ribs 10 and 11 also have two pairs of lugs 16, 17 and 18, 19 directed horizontally toward the inside and leaving two passages 20 and 21. The purpose of these lugs 16 to 19 will be explained later.

Mounted between the ribs 10 and 11 is a catching and locking element common to the four catchment points. This catching element consists of two parallel bars 22 which for reasons of simplicity will hereafter be referred to by the term lock. This lock 22 is mounted so that it can slide and longitudinally between the ribs 10 and 11. It is retained vertically, on the one hand, by the base 9 and, on the other hand, by the lugs 16 to 19 which guide it. The lock 22 is equipped with two pairs of hooks 23 and 24 intended to retain and lock the rods 3 and 4 of the boot in the notches 12 to 15. The rear end of the lock 22 is articulated, about a pin 25, to the lower part of an arm 26 rising approximately vertically up from the base 9 and simultaneously constituting a release lever. The pin 25 passes through the ribs 10 and 11 through a pair of longitudinal slots 27, allowing the pin 25 to move longitudinally.

Articulated about a pin 28 at an intermediate point along the lock 22 is a latch 29 equipped at its end with a hook 30 by means of which the latch catches over the lugs 18 and 19. The latch 29 is equipped with a stub 31 situated just above the pin 28. Fastened to this stub is the end of a spring 32 working in tension, the other end of which is attached to a point 33 of the base. Given the short distance between the pin 28 and the point 31 of attachment of the spring to the latch, the spring 32 exerts a relatively small torque on the latch, but a torque which is quite enough to keep the latch in a position caught on the lugs 18 and 19. This same spring 32 tends to pull the bolt 22 forward with great force. This lock is, however, retained by the latch 29, itself retained by the lugs 18 and 19. When the boot is put on, the rod 4 is engaged first in the front notches 12 and 13, as is consistent with a normal position of the foot during the boot-fitting operation. The heel of the boot is then lowered so that its rear rod 3 engages in the notches 14 and 15. Given that the latch 28 passes across the profile of the notches 14 and 15, as can be seen in FIG. 3, the rod 3 encounters the catch 29 and pushes it downward. This has the effect of releasing the catch and with it the bolt 22 which then locks the rods 3 and 4 under the effect of the spring 32. During this movement, the pin 25 of the arm 26 is driven forward. Given, however, that the lower end 34 of the arm 26 presses at 35 against the base 9, this pulling has the effect of making the upper part of the arm 26 pivot forward and thus of pressing it against the boot.

To release the boot, all that is required is for the arm 26 to be pulled backward, its pin 25 driving the bolt until the catch 29 again catches onto the lugs 18 and 19.

The upper part of the arm 26 is fitted with a device for connecting this arm to the boot. This device consists simply of a wire spring 36 in the overall shape of a U which has a narrowing forming two opposed teeth 37, 38 (FIG. 4) that can pass through two slits 40 formed in the bottom of two lateral grooves in the arm 26, in which grooves the spring 36 can slide vertically. These teeth 37 and 38 emerge into a housing 39 of approximately rectangular shape, in which the piece 5 of the boot can engage.

During this engagement, the spring 36 is parted by two ramps 51 of the piece 5 in order to allow the teeth 37 and 38 to clip into the grooves 6 and 7. The arm 26 is thus connected to the boot in such a way as to retain the upper of this boot laterally, while allowing the boot to flex forward, the teeth 37 and 38 sliding in the grooves 6 and 7. The length of the housing 39 must of course also allow this flexing, as shown by the sectional view that is FIG. 3.

In order to release the boot from the arm 26 all that is required is for the spring 36 to be pulled upward: the teeth 37 and 38 come into abutment on the edges of the holes of the grooves of the lever 26 and move apart.

The base 9 is adapted to the type of gliding board.

In FIGS. 1 to 4, the base 9 is adapted for attachment to a downhill (alpine) ski by means of a ski binding that can accommodate a standardized boot sole. For this, the base 9 has a front lip 41 and a rear lip 42 similar to those on a ski boot sole. In this case, the interface will also act as a raiser plate.

Figure 5:
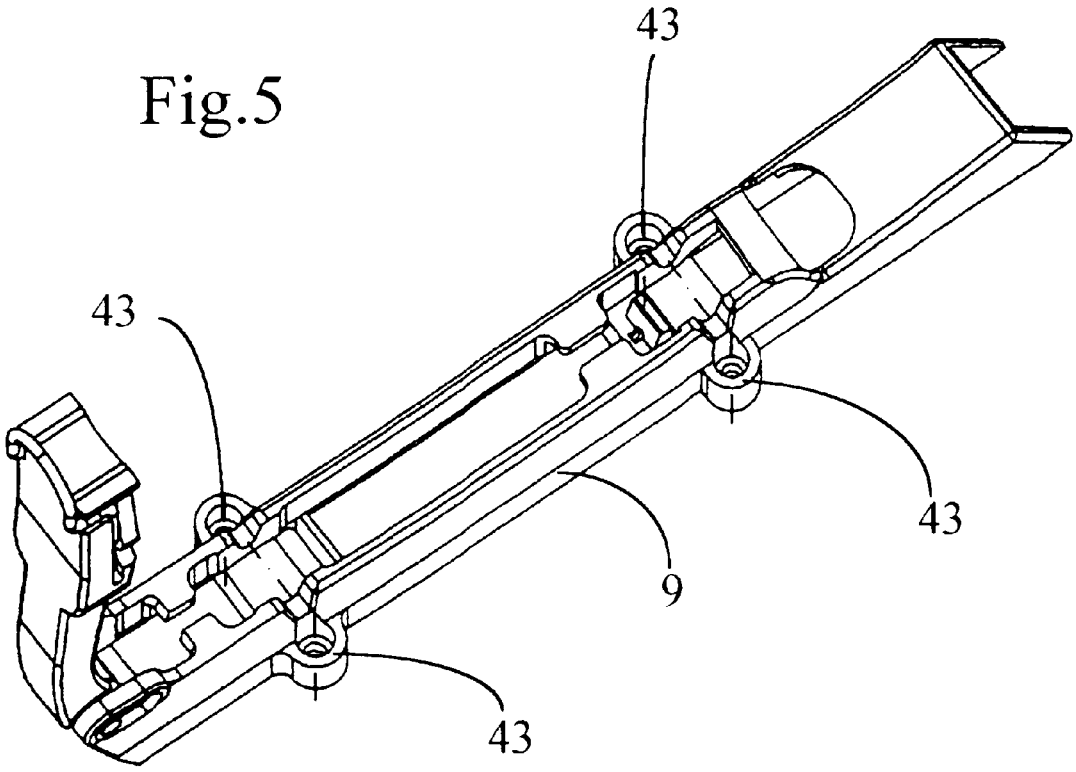
FIG. 5 is a perspective view of the same interface, without the catching and locking means, adapted for being attached to a compact ski for climbing.

In FIG. 5, the base 9 is equipped with two pairs of lateral lugs 43 for attaching it to a compact ski, generally for climbing, by means of four screws.

Figure 6:
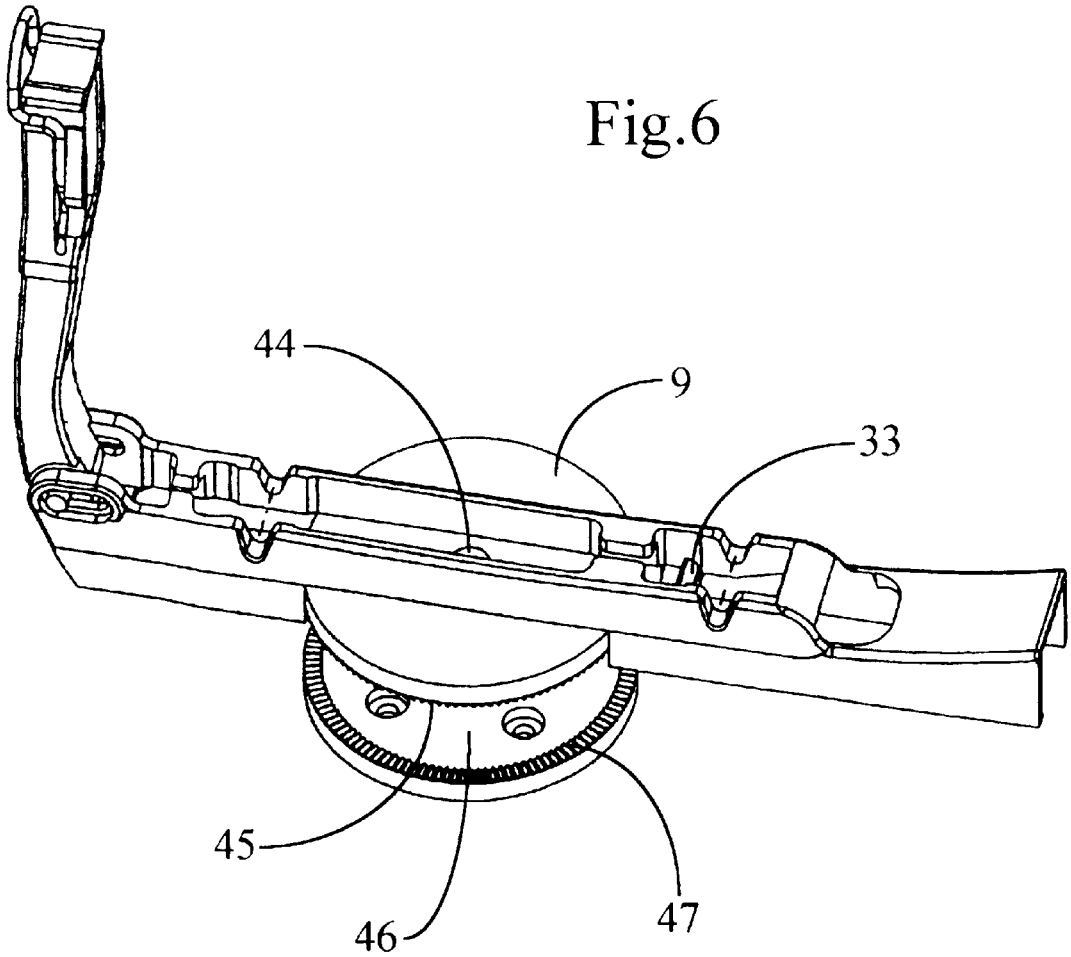
FIG. 6 is a perspective view of the same interface, without the catching and locking means, adapted for attachment to a snowboard.

In FIG. 6, the base 9 has the form of a disk with a central hole 44 and a toothed ring 45 on its lower face so that the interface can be attached to a circular plate 46 fixed to a snowboard and also equipped with a toothed ring 47 on its upper face, the toothed rings 45 and 47 allowing the interface to be attached to the snowboard by a central screw in the desired angular position.

The release lever may advantageously be used as a handle for manipulating the interface.

The locking device could of course be produced in a different way. In particular, the locking means could consist of two independent catching and locking elements specific to each of the rods 3 and 4 of the boot. These catching and locking elements could each be articulated about a pin situated beneath the V-shaped notches and each fitted with a latch. The two locking devices are preferably mounted in such a way as to work in opposite directions so that release can be achieved by means of a cable, one of the ends of which is attached to the arm 26, and the other end of which is attached to one of the locking devices, in this case passing over a return pulley mounted on the other locking device so that pulling the cable tends to move the two locking devices closer together and tends to move them away from the rods of the boot.

Locking could, of course, also be achieved without a catch, the pressure of the rods 3 and 4 of the boot moving the lock 22 away by means of the ramps formed on the hooks 23, 24. In this case, release would be achieved by pushing the lock against the action of a spring.

Release could also be achieved by means other than the arm 26, for example by means of a pull strap or a lateral lever, like in the prior art.

What is claimed is:

1. An interface for connecting a sports boot with a gliding board, the boot having a tall, soft upper and a flexible sole with at least one longitudinal groove of trapezoidal cross section and four attachment points therein, said interface having, on an upper side, an outer profile of trapezoidal overall shape similar to that of the longitudinal groove in the boot and intended to engage within the groove of the boot and means for automatically catching and locking the four attachment points of the boot and an arm rising up approximately vertically from a rear end of the interface and equipped with means of connection to a back portion of the upper of the boot, the lower part of said interface having attachment means adapted for attachment to a gliding board.

2. The interface as claimed in claim 1, wherein the attachment means consist of lugs intended to be attached by screws to a short ski.

3. The interface as claimed in claim 1, wherein the attachment means consist of a rigid plate equipped with a front lip and with a rear lip for attaching the rigid plate to a ski safety binding.

4. The interface as claimed in claim 1, wherein the attachment means consist of a disk with a notched lower face intended to be fixed onto a similar notched base of a snowboard.

5. The interface as claimed in claim 1, wherein said approximately vertical arm simultaneously constitutes a release lever.

6. The interface as claimed in claim 1, wherein the means of connecting said arm to the back portion of the upper of the boot consist of a spring in the overall shape of a U having a narrowing portion that forms two opposed teeth intended to clip into housings in the boot.

7. The interface as claimed in claim 6, wherein said spring is mounted so as to slide longitudinally on said arm, the arm having ramps which part the spring when the spring is pulled upward, so as to disengage the teeth from the housings in the boot.

8. The interface as claimed in claim 1, wherein the four attachment points of the sole consist of two rods passing across said longitudinal groove in the sole at right angles to the groove.

9. The interface of claim 1, wherein the means of connection is an interlocking means which interlocks with a corresponding portion attached to the back portion of the upper of the boot.

10. An interface for connecting a sports boot with a gliding board, the boot having a tall, soft upper, a flexible sole with at least one longitudinal groove of trapezoidal cross section and four attachment points therein, said interface having, on an upper side, an outer profile of trapezoidal overall shape similar to that of the longitudinal groove in the boot and intended to engage within the groove of the boot and means for automatically catching and locking the four attachment points of the boot and an arm rising up approximately vertically from a rear end of the interface and equipped with means of connection to the back of the upper of the boot, the lower part of said interface having attachment means adapted to a gliding board, wherein the profile of trapezoidal overall shape of the interface consists of two ribs with V-shaped notches intended to accommodate said rods and wherein the means of catching and unlocking the rods in the V-shaped notches consist of two parallel plates that can move longitudinally and equipped with nibs intended to fit over the rods and with a spring tending to keep said nibs over the rods.

11. An interface for connecting a sports boot with a gliding board, the boot having a tall, soft upper, a flexible sole with at least one longitudinal groove of trapezoidal cross section and four attachment points therein, said interface having, on an upper side, an outer profile of trapezoidal overall shape similar to that of the longitudinal groove in the boot and intended to engage within the groove of the boot, wherein the profile of trapezoidal overall shape of the interface consists of two ribs with V-shaped notches intended to accommodate said rods and means of automatically catching and locking the four attachment points of the boot and an arm rising up approximately vertically from a rear end of the interface and equipped with means of connection to a back portion of the upper of the boot, the lower part of said interface having attachment means adapted to a gliding board, wherein the means of catching and unlocking the rods in the V-shaped notches consist of two parallel plates that can move longitudinally and equipped with nibs intended to fit over the rods and with a spring tending to keep said nibs over the rods and a latch for keeping said parallel plates in the unlocked position, this latch being positioned, relative to the bottom of one of the pairs of V-shaped notches, so that it is pushed back by the corresponding rod when the boot is fitted to the interface.

* * * * *